US006524410B1

(12) United States Patent
Kramer et al.

(10) Patent No.: US 6,524,410 B1
(45) Date of Patent: Feb. 25, 2003

(54) METHOD FOR PRODUCING HIGH STRENGTH ALUMINUM ALLOY WELDED STRUCTURES

(75) Inventors: Lawrence Stevenson Kramer, Dayton, MD (US); William Troy Tack, Glenely, MD (US)

(73) Assignee: Tri-Kor Alloys, LLC, Glenwood, MD (US)

( * ) Notice: Subject to any disclaimer, the term of this patent is extended or adjusted under 35 U.S.C. 154(b) by 0 days.

(21) Appl. No.: 09/927,001

(22) Filed: Aug. 10, 2001

(51) Int. Cl.[7] ..... C22F 1/053

(52) U.S. Cl. ..... 148/550; 148/690; 148/701; 148/702

(58) Field of Search ..... 148/550, 690, 148/701, 702

(56) References Cited

U.S. PATENT DOCUMENTS 3,306,787 A * 2/1967 Dies ..... 148/439
4,212,405 A * 7/1980 Schmidt ..... 296/78.1
5,129,666 A * 7/1992 Lai ..... 280/281.1
5,507,888 A * 4/1996 Dickson et al. ..... 148/415
5,597,529 A * 1/1997 Tack ..... 420/529
5,620,652 A * 4/1997 Tack et al. ..... 420/532
2001/0037844 A1 * 11/2001 Bekki et al. ..... 148/440

* cited by examiner

*Primary Examiner*—George Wyszomierski
*Assistant Examiner*—Janelle Combs-Morillo

(57) ABSTRACT

The present invention relates to a method for fabricating lightweight alloy feedstock for welded structures. Specifically, the method for producing the tubular stock proposed in the present invention enables a bicycle manufacturer to readily weld a lightweight yet high strength bicycle frame. The properties attained in the final product allow the bicycle manufacturer to reduce the overall weight of the bicycle without sacrificing durability.

20 Claims, No Drawings

METHOD FOR PRODUCING HIGH STRENGTH ALUMINUM ALLOY WELDED STRUCTURES

BACKGROUND OF INVENTION

The present invention relates to the fabrication of high strength aluminum alloy welded structures. High-strength aluminum alloys, for example, alloys with a yield strength of >60 ksi, have not been utilized for welded frame construction due to the inherently poor weldability of this class of alloys. The purpose of this invention is to provide a welded structure fabricated from high-strength aluminum.

One application for a high strength welded structure is a bicycle frame. Every year, a large number of aluminum bicycle frames are manufactured. Aluminum alloys provide a good combination of low density and good strength for this application. Bicycle frames are typically manufactured by fusion welding thin-walled tubes. The tubes are assembled as either a single frame unit or as component units that are joined together, for example by suspension members.

When selecting an aluminum alloy for use in bicycle frames, the manufacturer emphasizes the use of "weldable" aluminum alloys. The characteristic most used to describe weldability is resistance to hot tearing during welding. Hot tearing resistance is typically good for alloys with only small amounts of alloying additions due to their small freezing range. In addition, binary alloys that are heavily alloyed can also be resistant to hot tearing due to their ability to heal any tears with solidifying (usually eutectic) liquid. To obtain higher strengths, a relatively high level of several alloying additions results in a large freezing range, thereby increasing hot tearing during welding. Accordingly, only moderate strengths alloys are used for welded applications.

The most popular alloys used for aluminum bicycle frame manufacture include 6061 and 7005, although other 6xxx and 7xxx alloy variants are sometimes used. To a lesser extent, some 2xxx and 5xxx alloys have also been used for frame construction. 6061-T6 offers good strength, corrosion resistance and weldability. Bicycle frames constructed from 6061 tubes are typically welded in the T4 or T6 condition and subsequently re-solution heat treated, quenched and aged back to a T6 temper. Alloy 7005 is typically welded in the T6 temper and can be aged after welding without the re-solution heat treatment step. Alternatively, it can also be solution heat treated after the frame is welded. 5086-H32, has also been used for frame construction and is a non-heat treatable alloy. Of these aforementioned weldable alloys, the highest yield strength attained is about 44 ksi in the case of 7005-T6.

Bicycle frames manufactured from higher strength aluminum alloys than the above-mentioned ones have not been utilized for welded construction. Alloy variants 7075 and 7050, which display much higher yield strengths than conventional weldable alloys, have been utilized for bicycle frames that are constructed via mechanical fastening and adhesive bonding. Alloys such as 7075 and 7050 are difficult to fusion weld and exhibit hot tearing, especially in applications where the weld zone is stressed. Thin tube welding, circular welds and other aspects of bicycle frame construction can impart significant stresses on the weld zone thereby eliminating the consideration of high-strength aluminum alloys for this application. It would be a remarkable achievement to derive an aluminum alloy that can be readily welded while attaining yield strengths equivalent to or greater than high strength alloys such as 7075 and 7050.

DESCRIPTION OF RELATED ART

Bicycle frames have been fabricated from a number of aluminum alloys, as described. Despite the foregoing, there remains a need for lighter, stronger bicycle frames. One way to achieve this is to utilize higher strength aluminum alloys in frame construction, although the use of such materials has been thwarted by their poor weldability. This invention provides a welded-construction bicycle frame of higher strength than previously used. The higher strength of the alloy can be used by designers to produce lighter weight and/or higher strength frames. U.S. Pat. No. 5,507,888 describes the use of an improved 6xxx alloy for bicycle frame tubing. While this patent describes a bicycle frame and an alloy that is improved over the common 6061-T6 construction, it nevertheless displays only a limited improvement in strength. The patent describes strength and elongation values as given in the following table:

| Alloy - Temper | Yield Strength (ksi) | Ultimate Tensile Strength (ksi) | Elongation (%) |
|---|---|---|---|
| 5086-H32 | 28 | 40 | 8 |
| 6061-T6 | 35 | 42 | 10 |
| 7005-T62 | 44 | 50 | 10 |
| US5507888-T6 | 47 | 52 | 8 |

U.S. Pat. No. 5,129,666 describes an aluminum alloy bicycle frame in which the tubes that comprise the bicycle frame are reinforced on their ends and threaded. The tubes are also configured to accept adhesive glue for assembly. While this method can allow for the use of high-strength aluminum alloys it is not pertinent for welded construction, as the topic of this invention is.

U.S. Pat. No. 5,597,529 and U.S. Pat. No. 5,620,652 describe various welding filler alloy and base metals in which the alloy modifications are such that weldability is enhanced. A wide array of compositions are proposed as are a number of welded structures including bicycle frames. However, the actual use of the proposed alloys is not reduced to practice and the method of producing any of the alloy formulations into a suitable tubular member is not described. In the present invention, the specific processing sequence is derived to enable the method of fabricating high strength bicycle frames.

SUMMARY OF INVENTION

The present invention provides for an aluminum alloy bicycle frame manufactured by welded construction utilizing an aluminum alloy with a yield strength in excess of 70 ksi. The frame can thus be made stronger or lighter weight and enables more design options. Previously, aluminum alloys in this strength regime were relegated to bicycle frames that were fabricated via mechanical fastening techniques due to their poor weldability. The bicycle frame of this invention displays both high strength and good weldability. It is preferred that the alloy of this frame, or the tube stock from which the frame components are manufactured from, is a 7xxx-type, or Al—Mg—Zn alloy. It is further preferred that the alloy be extruded and drawn as a tubular member.

DETAILED DESCRIPTION

According to the present invention, a bicycle frame is constructed by welding, wherein the yield strength of the aluminum alloy tubular members of said frame is above 70 ksi. The alloy is processed via extrusion and drawing as a tubular member. In a preferred embodiment of the invention, the aluminum alloy tubular members are a 7xxx-type alloy.

EXAMPLES

Example 1

Tubular members for bicycle frame construction were fabricated from an alloy with the composition shown in Table 1. Fabrication steps included the direct-chill casting of the alloy followed by billet homogenization and extrusion into seamless tube. The seamless tube extrusion was then drawn through a series of dies to produce the final size. In this case, the tube size was 1.37-inch outer diameter tube with a 0.080-inch wall thickness. The drawn tube was then subjected to a T6 heat treatment which includes the steps of solution heat treatment at 875° F., quenching in water, and artificial aging using the aging time and temperatures listed in Table 2.

TABLE 1

Composition of the 7xxx Tube, weight %

| Zn | Mg | Cu | Zr | Sc | Cr | Al |
|---|---|---|---|---|---|---|
| 5.09 | 1.83 | 0.32 | 0.12 | 0.07 | 0.06 | balance |

Two alternate T6 artificial aging practices were evaluated and tensile test results on the extruded, drawn and heat treated tubes are shown in Table 2. The mean yield strength of the alloy, >80 ksi, is much higher than that used previously for welded bicycle frame construction. As shown, the ductility, as measured by tensile elongation, is still quite high, which is important for ease of further frame fabrication.

TABLE 2

T6 Tensile Properties of the 7xxx Tube

| Artificial Aging | Yield Strength (ksi) | Ultimate Tensile Strength (ksi) | elongation (%) |
|---|---|---|---|
| 250° F. (16 h) | 77.0 | 82.0 | 13.0 |
| 250° F. (16 h) | 83.0 | 88.5 | 15.0 |
| 250° F. (24 h) | 85.5 | 90.5 | 15.0 |
| 250° F. (24 h) | 81.5 | 86.5 | 14.0 |

To simulate bicycle frame construction, tube-to-tube butt welds were made utilizing a manual gas tungsten arc (GTA) setup and hand held 5356 alloy weld filler rod. Numerous welds were made in which the tubes were clamped in place. Various initial and post-weld heat treatment combinations were used as shown in Table 3. Even though the clamping and geometrical configuration induced significant strain upon the weldments, no cracking or other defects were observed. In addition, weld strengths are significantly higher than those for conventional 7005 and 6061.

TABLE 3

GTA Butt Weld Properties

| Alloy | Pre-Weld Heat Treatment | Post-Weld Heat Treatment | Yield Strength (ksi) | Ultimate Tensile Strength (ksi) | elongation (%) |
|---|---|---|---|---|---|
| This invention | Partial T6* | 250° F. | 40.5 | 52.9 | 5.2 |
| | | (12 h) | 43.2 | 51.2 | 5.4 |
| | | 320° F. | 45.0 | 55.9 | 5.4 |
| | | (8 h) | 43.7 | 51.5 | 5.2 |
| | T6** | 250° F. | 40.2 | 50.9 | 5.6 |
| | | (12 h) | 42.0 | 54.3 | 5.5 |
| | | 320° F. | 42.2 | 52.7 | 5.2 |
| | | (8 h) | 39.0 | 50.1 | 5.1 |
| 7005 | T53 | None | 25 | 44 | 10 |
| | | T53 | 33 | 50 | 4 |
| 6061 | T6 | None | 18 | 27 | 8 |
| | | T6 | 40 | 44 | 5 |
| | T4 | T6 | 24 | 35 | 3 |

*250° F. (12 hours)
**250° F. (24 hours)
7005 and 6061 data from: Welding Handbook, vol. 3, 8th ed., American Welding Society, 1996, p. 105

What is claimed is:

1. A method for producing a lightweight welded structure comprising:

a) mixing alloy elements into aluminum with the alloy composition containing 4.2 to 6.5 wt. % Zn, 1.0 to 2.5 wt. % Mg, 0 to 0.70 wt. % Cu, and 0.05 to 1.0 wt. % of at least one grain refining element selected from a group consisting of Zr, Sc, Cr, Mn, Ti, Hf and V, the remainder comprising aluminum, incidental elements and impurities, and casting the alloy into a billet;

b) homogenizing said billet at an elevated temperature to provide suitable starting stock for extrusion;

c) extruding said billet into tube;

d) optionally, drawing said extruded tube into a thinner walled tube with one or more drawing passes;

e) solution heat treating said tubular members;

f) quenching said tubular members;

g) artificial aging said tubular members;

h) welding said tubular members together to form a welded structure;

i) further aging said welded structure at ambient temperature or greater to effect strengthening of the weldment wherein at least one of the tubular members of the welded structure have a tensile yield strength of at least 60 ksi measured in the longitudinal direction of the tubular member.

2. The method of claim 1 wherein at least one of the tubular members of the welded structure have a tensile yield strength of at least 70 ksi measured in the longitudinal direction of the tubular member.

3. The method of claim 1 wherein at least one of the tubular members of the welded structure have a tensile yield strength of at least 60 ksi measured in the longitudinal direction of the tubular member and an elongation of at least 8% measured in the longitudinal direction of the tubular member.

4. The method of claim 1 wherein at least one of the tubular members of the welded structure have a tensile yield strength of at least 70 ksi measured in the longitudinal direction of the tubular member and an elongation of at least 8% measured in the longitudinal direction of the tubular member.

5. The method of claim 1 in which the additional step of performing a working operation to said tube to provide a final shaped tube member and/or a tube member with varying the thickness along the length of the tube is included prior to solution heat treatment.

6. The method of claim 1 wherein after welding said tubular members (step h) the additional steps of:

a) solution heat treating said welded structure;

b) quenching said welded structure members; and:

c) further aging said welded structure at ambient temperature or greater to effect strengthening of the weldment are performed after the welding of the tubular members.

7. The method of claim 1 wherein the welded structure is a bicycle frame, wheelchair, scooter, motorcycle frame, substructure or component or an automotive space frame.

8. A method for producing a lightweight welded structure comprising:

a) mixing alloy elements into aluminum with the alloy composition containing 4.2 to 6.5 wt. % Zn, 1.0 to 2.5 wt. % Mg, 0 to 0.70 wt. % Cu, and 0.05 to 1.0 wt. % of at least one grain refining element selected from a group consisting of Zr, Sc, Cr, Mn, Ti, Hf and V, the remainder comprising aluminum, incidental elements and impurities, and casting the alloy into a billet;

b) homogenizing said billet at a temperature greater than 600° F. to provide suitable starting stock for extrusion;

c) extruding said billet into tube at an extrusion temperature between 600° F. and 900° F.;

d) optionally, drawing said extruded tube into a thinner walled tube with one or more drawing passes;

e) solution heat treating said tubular members at a temperature between 800° F. and 900° F.;

f) quenching said tubular members;

g) artificial aging said tubular members at a temperature of at least 200° F.;

h) welding said tubular members together to form a welded structure;

i) further aging said welded structure at ambient temperature or greater to effect strengthening of the weldment;

wherein at least one of the tubular members of the welded structure have a tensile yield strength of at least 60 ksi measured in the longitudinal direction of the tubular member.

9. The method of claim 8 wherein at least one of the tubular members of the welded structure have a tensile yield strength of at least 70 ksi measured in the longitudinal direction of the tubular member.

10. The method of claim 8 wherein at least one of the tubular members of the welded structure have a tensile yield strength of at least 60 ksi measured in the longitudinal direction of the tubular member and an elongation of at least 8% measured in the longitudinal direction of the tubular member.

11. The method of claim 8 wherein at least one of the tubular members of the welded structure have a tensile yield strength of at least 70 ksi measured in the longitudinal direction of the tubular member and an elongation of at least 8% measured in the longitudinal direction of the tubular member.

12. The method of claim 8 in which the additional step of performing a working operation to said tube to provide a final shaped tube member and/or a tube member with varying the thickness along the length of the tube is included prior to solution heat treatment.

13. The method of claim 8 wherein after welding said tubular members (step h) the additional steps of:

a) solution heat treating said welded structure at a temperature between 800° F. and 900° F.;

b) quenching said welded structure members; and:

c) further aging said welded structure at ambient temperature or greater to effect strengthening of the weldment are performed after the welding of the tubular members.

14. The method of claim 8 wherein the welded structure is a bicycle frame, wheelchair, scooter, motorcycle frame, substructure or component or an automotive space frame.

15. A method for producing a lightweight welded structure comprising:

a) mixing alloy elements into aluminum with the alloy composition containing 4.2 to 6.5 wt. % Zn, 1.0 to 2.5 wt. % Mg, 0 to 0.70 wt. % Cu, and 0.05 to 1.0 wt. % of at least one grain refining element selected from a group consisting of Zr, Sc, Cr, Mn, Ti, Hf and V, the remainder comprising aluminum, incidental elements and impurities, and casting the alloy into a billet;

b) homogenizing said billet to provide suitable starting stock for extrusion;

c) extruding said billet into tube;

d) optionally, drawing said extruded tube into a thinner walled tube with one or more drawing passes;

e) optionally, solution heat treating and quenching said tubular members;

f) optionally, artificial aging said tubular members;

g) welding said tubular members together to form a welded structure;

h) solution heat treating said welded structure;

i) quenching said welded structure members;

j) further aging said welded structure at ambient temperature or greater to effect strengthening of the weldment, wherein at least one of the tubular members of the welded structure have a tensile yield strength of at least 60 ksi measured in the longitudinal direction of the tubular member.

16. The method of claim 15 wherein at least one of the tubular members of the welded structure have a tensile yield strength of at least 70 ksi measured in the longitudinal direction of the tubular member.

17. The method of claim 15 wherein at least one of the tubular members of the welded structure have a tensile yield strength of at least 60 ksi measured in the longitudinal direction of the tubular member and an elongation of at least 8% measured in the longitudinal direction of the tubular member.

18. The method of claim 15 wherein at least one of the tubular members of the welded structure or have a tensile yield strength of at least 70 ksi measured in the longitudinal direction of the tubular member and an elongation of at least 8% measured in the longitudinal direction of the tubular member.

19. The method of claim 15 in which the additional step of performing a working operation to said tube to provide a final shaped tube member and/or a tube member with varying the thickness along the length of the tube is included prior to solution heat treatment.

20. The method of claim 15 wherein the welded structure is a bicycle frame, wheelchair, scooter, motorcycle frame, substructure or component or an automotive space frame.

* * * * *